US006126082A

United States Patent [19]

Doyle

[11] Patent Number: 6,126,082

[45] Date of Patent: Oct. 3, 2000

[54] PIN HOLE HEATING OF A FLOWING LIQUID

[76] Inventor: Daniel Doyle, P.O. Box 534, Standish, Me. 04084

[21] Appl. No.: 09/286,476

[22] Filed: Apr. 5, 1999

[51] Int. Cl.[7] ..... B60H 1/02

[52] U.S. Cl. ..... 237/12.3 R; 237/12.3 B

[58] Field of Search ..... 237/12.3 R, 12.3 B; 126/22; 122/247; 123/142.5 R

[56] References Cited

U.S. PATENT DOCUMENTS 2,764,147 9/1956 Brunner ..... 237/12.3 R 4,974,778 12/1990 Bertling ..... 237/12.3 R 5,954,266 9/1999 Hoshino et al. ..... 237/12.3 R

*Primary Examiner*—Harold Joyce

*Assistant Examiner*—Derek S. Boles

*Attorney, Agent, or Firm*—Frederick R. Cantor, Esq.

[57] ABSTRACT

Heat exchanger liquid can be heated by pumping the pressurized liquid through multiple pin hole openings in partitions spaced along the flow conduit that contains the liquid. The pin holes in each partition exert a heating action on the flowing liquid by causing the liquid to have a high degree of boundary layer turbulence.

10 Claims, 3 Drawing Sheets

PIN HOLE HEATING OF A FLOWING LIQUID

BACKGROUND OF THE PRESENT INVENTION

Summary of the Present Invention

This invention relates to a mechanism for heating a flowing liquid by the action of multiple pin holes in the conduit that contains the liquid. The invention is particularly applicable to heat exchange liquid used for heating domestic hot water or for heating air in residential furnaces.

In most domestic water heaters or residential hot air furnaces the water, or air, is heated by gaseous combustion or by electrical hot wire heater elements. The present invention departs from conventional practice in that heat is derived from turbulent boundary layer flow of heat exchanger liquid through multiple pin holes in transverse partitions spaced along the conduit used to contain the flowing liquid.

The present invention produces the desired heating action without using gaseous combustion or electrical hot wire heating. In some respects the present invention represents a simplification of the apparatus used conventionally for hot water heating or hot air furnace heating. In many situations, the heating apparatus of the present invention can be more compact than the conventional apparatus having a comparable heat output.

Specific features and advantages of the invention will be apparent from the attached drawings and description of an apparatus embodying the invention.

In summary, and in accordance with the above, the foregoing objectives are achieved in the following described embodiments.

1. A heating mechanism comprising:

a flow conduit;

at least one plate extending transversely across said conduit;

multiple heat-producing pin holes extending through each said plate;

means for supplying pressurized heat exchange liquid to said conduit, so that the liquid is forced to flow through said pin holes in order to move through the conduit; and said pin holes having closely spaced edges presented to the liquid so that most of the liquid flow is in the turbulent boundary layer region.

2. The heating mechanism, as described in paragraph 1, wherein each pin hole has a star cross section.

3. The heating mechanism, as described in paragraph 1, wherein each pin hole has an eight point star cross section.

4. The heating mechanism, as described in paragraph 1, wherein each pin hole has a cross section that is less than one eighth inch in any direction measured from the pin hole axis.

5. The heating mechanism, as described in paragraph 1, wherein there are at least four plates spaced along said conduit; and each plate having multiple pin holes extending therethrough, whereby each plate exerts a heating action on the flowing liquid.

6. The heating mechanism, as described in paragraph 1, wherein there are at least four plates spaced along said conduit; said conduit having a central axis; each plate having multiple pin holes extending therethrough, whereby each plate exerts a heating action on the flowing liquid; and the pin holes in successive plates being offset in different directions from the conduit central axis, whereby the liquid undergoes a mixing action as it moves between successive plates.

7. The heating mechanism, as described in paragraph 1, wherein each said plate has at least fifty pin holes extending therethrough.

8. The heating mechanism, as described in paragraph 1, wherein the heat exchange liquid is oil.

9. The heating mechanism, as described in paragraph 1, wherein said means for supplying pressurized liquid to said conduit comprises a motor-operated pump; and means for regulating the heating action of said pin holes; and said regulating means comprising a temperature sensor responsive to elevated temperates produced by the heated liquid, and a pump controller operated by said temperature sensor.

10. The heating mechanism, as described in paragraph 1, and further comprising a hot water heater that includes a helical water passage surrounding said flow conduit, whereby the heated liquid flowing through said conduit transfers heat to the water in said helical water passage.

11. The heating mechanism, as described in paragraph 1, and further comprising a hot water heater that includes a helical water passage surrounding said flow conduit, a first annular duct connected to said flow conduit within the space circumscribed by the helical water passage, and a second annular duct connected to said first duct in surrounding relation to said helical water passage, whereby said helical passage is heated at its inner surface and at its outer surface.

DESCRIPTION OF THE PREFERRED EMBODIMENTS OF THE PRESENT INVENTION

Figure 1:
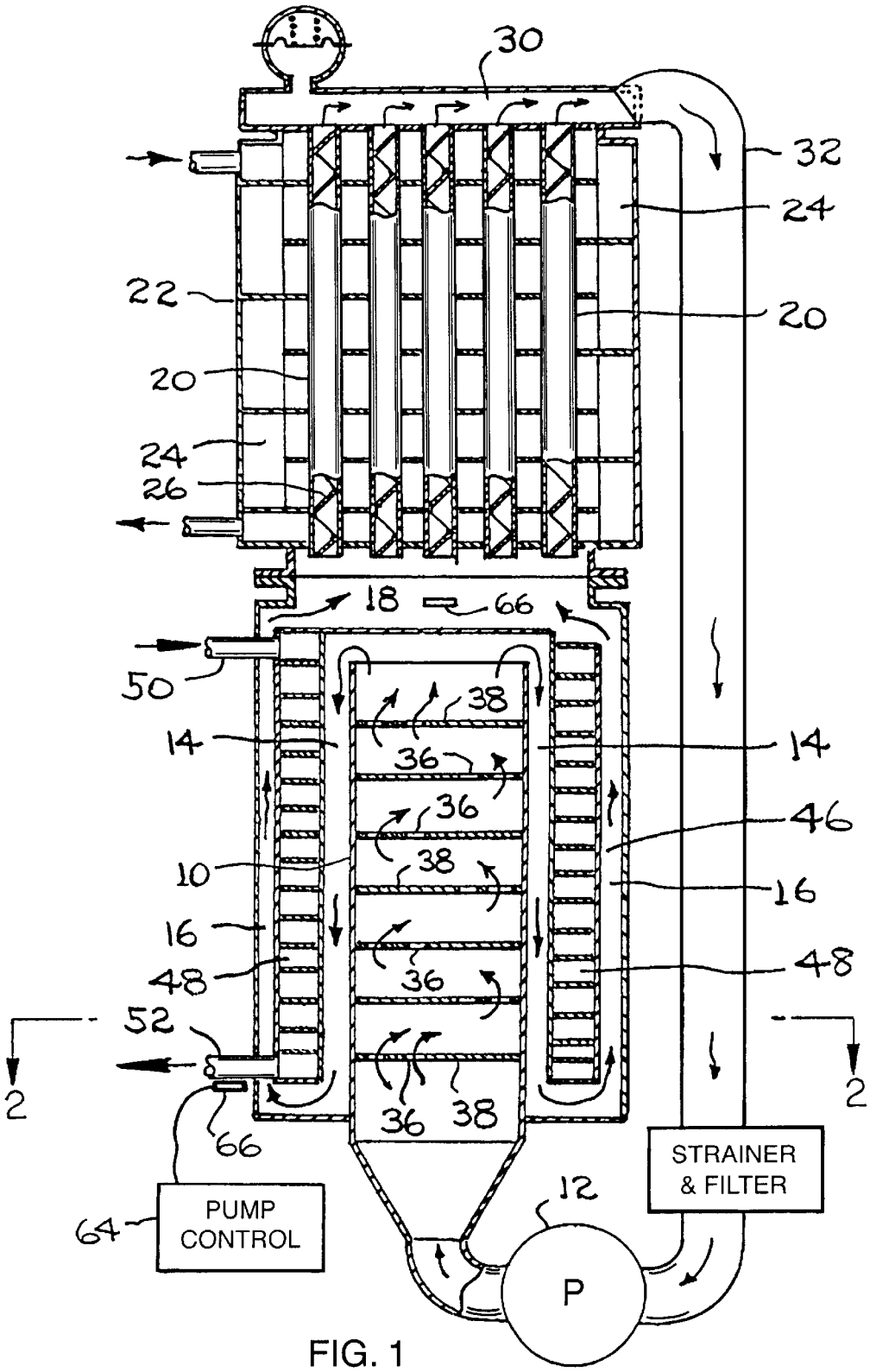
FIG. 1, is a view, partly in section, showing an apparatus embodying the invention.

FIG. 1, is a view, partly in section, showing an apparatus embodying the invention.

Referring to FIG. 1, there is shown a water-heating apparatus embodying the invention. The apparatus comprises a generally vertical cylindrical conduit 10 having a lower inlet end connected to the high pressure discharge port of a motor-operated hydraulic pump 12. A check valve can be provided between pump 12 and conduit 10 to prevent liquid backflow. Conduit 10 and pump 12 are located in a closed hydraulic (oil) circuit that includes a first annular duct 14 surrounding conduit 10, and a second outer annular duct 16 spaced radially outwardly form duct 14.

Duct 14 discharges heated oil into an overhead space 18 that directs the heated oil through vertical tubes 20 extending upwardly through a liquid-to-liquid heat exchanger 22. The other side of heat exchanger 22 includes a sinuous passage system 24 containing water that is to be heated by the upflowing oil in tubes 20. Each tube 20 may be equipped with a helical turbulator fin 26 that promotes heat transfer from the oil to the water in sinuous passage system 24. The water flowing through sinuous passage system 24 can be used in a baseboard room heating system (not shown). A conventional pump can be used for circulating water through passage system 24 and the baseboard room heating system.

The oil flows out of tubes 20 into a header 30 that communicates with a downwardly directed return pipe 32 leading back to the intake port of pump 12. It will be seen that the oil passage system provides a closed circuit, wherein the oil flows from pump 12 into conduit 10, thence through annular ducts 14 and 16 into central space 18. Oil flows from space 18 upwardly through heat exchange tubes 20, into header 30, and then through return pipe 32 back to pump 12.

In the illustrated system the oil is heated while it is passing upwardly through cylindrical conduit 10. The oil-heating action is produced by turbulent flow of oil through multiple pin holes 36 that extent through transverse partitions (plates) 38 spaced along conduit 10. As shown in FIG. 1, there are seven transverse plates 38 in conduit 10. Each plate produces an oil-heating action as the oil passes through the pin holes 36 in the respective plate.

Figure 2:
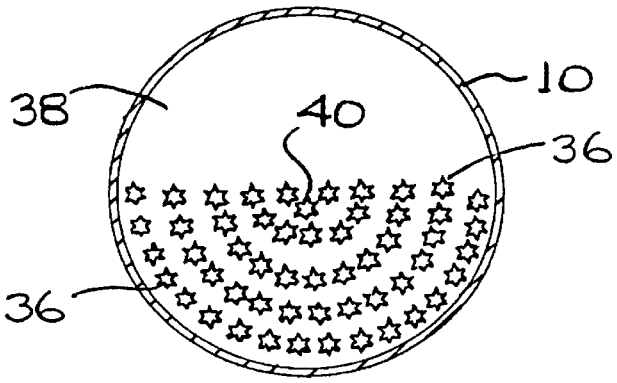
FIG. 2, is a transverse sectional view, taken on line 2—2 in FIG. 1, through a flow conduit employed in the FIG. 1 apparatus.

FIG. 2, is a transverse sectional view, taken on line 2—2 in FIG. 1, through a flow conduit employed in the FIG. 1 apparatus.

FIG. 2, shows a typical pin hole arrangement in one of the plates 38. As there shown, there are a large multiplicity of individual pin holes 36 spanning approximately one half the surface area of plate 38. Each plate contains upwards of fifty pin holes 36 occupying a specific area (or section) of the plate. As depicted in FIG. 2, pin holes 36 occupy the lower half section of plate 38; in other plates the pin holes will occupy other areas of the plate, (upper half, right half, left half, etc). The pin holes are offset from central axis 40 of conduit 10, with the offset being in different directions in successive plates, whereby the oil undergoes a generally sinuous motion as it traverses the various plates 38. The sinuous motion exerts a mixing action that tends to produce a relatively uniform oil temperature across the conduit 10 cross section.

As noted previously, each set of pin holes 36 produces a distinct heating action on the upflowing oil. For example, if we assume a total oil temperature increase (from the lower end of conduit 10 to the upper end of the conduit) to be one hundred degrees, then the temperature increases across each plate 38 will be approximately fourteen degrees (i.e. one hundred divided by seven).

Figure 3:
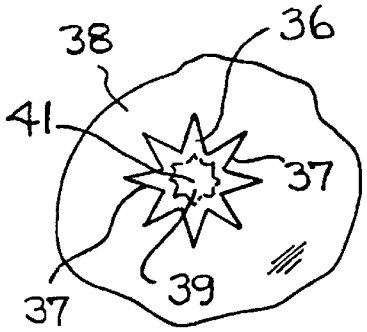
FIG. 3, is an enlarged view of a pin hole flow passage employed in a partition plate depicted in FIG. 2.

FIG. 3, is an enlarged view of a pin hole flow passage employed in a partition plate depicted in FIG. 2.

Each pin hole 36 has a relatively large edge length for a given hole area. As shown in FIG. 3, the hole 36 has an eight point star cross section, wherein the edges 37 of the hole have a relatively great total length in comparison to the hole area. Most of the liquid oil flowing through hole 36 will be in relatively close contact with a hole edge 37; the flow will be turbulent boundary layer flow (as opposed to smooth laminar flow). Only the central portion 39 of the flow will be laminar flow. Most of the flow (near hole edges 37) will be turbulent flow that produces a heating action on the flowing oil.

Each pin hole 36 is relatively small, in order to have most of the oil flow occur along the hole edges 37. In most cases the hole radius, measured from hole axis 41 is less than one eighth inch. Hole diameters on the order of about 0.2 inch, or less, are contemplated.

Figure 4:
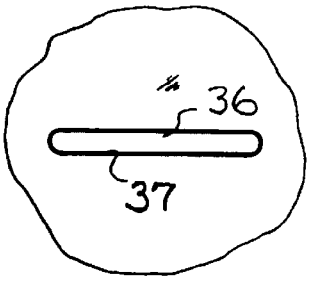
FIG. 4, shows a pin hole that can be used as an alternative to the pin hole shown in FIG. 3.

FIG. 4, shows a pin hole that can be used as an alternative to the pin hole shown in FIG. 3.

Various pin hole configurations can be used in practice of the invention. FIG. 4, shows a slot configuration, wherein all of the oil flow takes place near an edge of the hole. All of the flow will be boundary layer turbulent flow that produces a heating action on the flowing oil.

Figure 5:
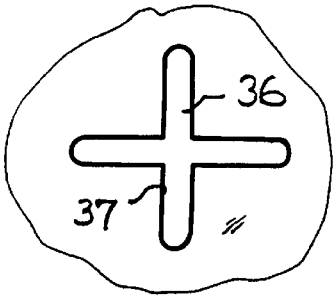
FIG. 5, shows another pin hole configuration that can be used in practice of the invention.

FIG. 5, shows another pin hole configuration that can be used in practice of the invention.

FIG. 5, shows a variant of the FIG. 4 slot configuration. The hole of FIG. 5 includes two intersecting slots that produce turbulent oil flow, useful in practice of the invention.

FIG. 1, shows seven plates (or baffles) 38 spaced along conduit 10 for achieving a seven state heating action on the upflowing oil. A lesser number of plates can be employed, depending on the oil temperature increase that is desired or needed. In most cases, at least four plates 38 are believed necessary.

The heated oil coming out of the upper end of conduit 10 flows downwardly through an inner annular duct 14 and then upwardly through an outer annular duct 16. Heat in the flowing oil is transferred to a domestic water heater 46 formed by a helical water passage 48. Relatively cool water is supplied to passage 48 by an intake pipe 50; heated water exits from passage 48 into a second pipe 52. Helical flow through passage 48 is achieved by a helical partition 54 winding around the passage from a point near intake pipe 50 to a point near exit pipe 52.

The oil flowing through annular ducts 14 and 16 heats the water in helical passage 48 in two directions, i.e. along the inner surface of passage 48, and also along the outer surface of passage 48. The hot oil leaving annular duct 16 flows into space 18 and then into the heat exchange tubes 20, where heat is imparted form the oil to the water flowing through passage 24.

The system depicted in FIG. 1 provides three heating actions. First, pin holes 36 in plates 38 generate heat in the oil flowing through conduit 10. Second, the heated oil imparts some of the heat to water flowing through helical passage 48. Third, the heated oil imparts additional heat to water flowing through sinuous passage 24. The water flowing through passage 24 can be used for baseboard room heating. The water flowing through helical passage 48 can be used as a domestic hot water source.

Figure 6:
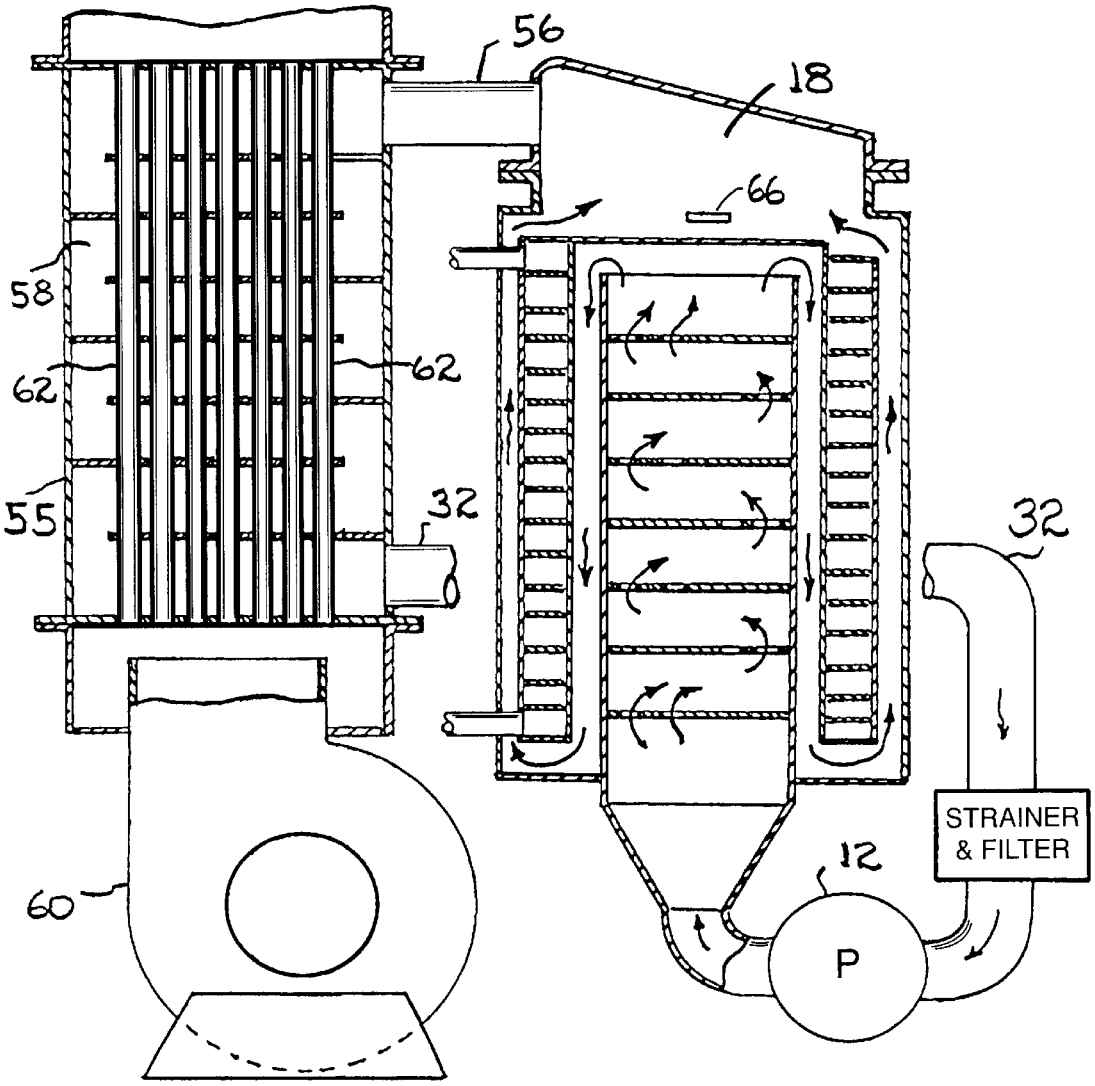
FIG. 6, shows another heating apparatus embodying the invention.

FIG. 6, shows another heating apparatus embodying the invention.

FIG. 6, shows a system that is identical with the FIG. 1 system except that heat exchanger 22 is replaced by a hot air furnace 55. Hot oil flows leftwardly from space 18 through a connector pipe 56 into a sinuous oil passage 58 in the hot air furnace.

A conventional centrifugal fan 60 directs air upwardly through air tubes 62 that extend through the sinuous oil passage 58, whereby the oil imparts heat to the upflowing air in tubes 62. The oil is returned to the intake port of pump 12 through a return pipe 32 that extends from sinuous passage 58.

With either the FIG. 1 or FIG. 6 system it is desirable that the temperature of the oil in space 18 be controlled at some value (or range), related to the heating requirements of the water heaters or air furnace. Such control can be achieved by regulating, or varying the oil-heating action of pin holes 36.

The heating action of each pin hole is affected by the linear flow rate through the pin hole. Higher flow rates produce greater heating action on the flowing oil. Lower flow rates through the pin holes produce lesser heating action.

The oil flow rate can be controlled by varying the pumping action of oil pump 12. If the pump has a fixed displacement the flow rate can be varied by varying the speed of the pump motor. If the pump has a variable displacement, the oil flow can be varied by operating the pump controller (to increase or decrease pump displacement).

In either case, a pump control device 64 of conventional design can be triggered by a temperature sensor 66 located either at oil space 18 or at the water exit pipe 52 for water heater 46. Sensor 66 directs the pump controller 64 to increase or decrease the oil flow through conduit, as necessary to bring sensor 66 to the desired equilibrium state (set point).

A principal feature of the invention is the pin hole 36 arrangement and pin hole construction that achieve the desired oil heating action without the need for an extraneous heat source (electric heater or gaseous combustion).

However, it will be appreciated by those skilled in the arts pertaining thereto, that the present invention can be practiced in various alternate forms, proportions and configurations. Further, the previous detailed description of the preferred embodiment of the present invention are presented for the purposes of clarity of understanding only, and no unnecessary limitations should be inferred therefrom. Finally, all appropriate mechanical and functional equivalents to the above, which will be obvious to those skilled in the arts pertaining thereto, are considered to be encompassed within the claims of the present invention.

What is claimed is:

1. A heating mechanism comprising:

a flow conduit;

at least one plate extending transversely across said conduit;

multiple heat-producing pin holes extending through each said plate;

means for supplying pressurized heat exchange liquid to said conduit, so that the liquid is forced to flow through said pin holes in order to move through the conduit; and said pin holes having closely spaced edges presented to the liquid so that most of the liquid flow is in the turbulent boundary layer region, wherein each said pin hole has a star cross section.

2. The heating mechanism, as described in claim 1, wherein each pin hole has an eight point star cross section.

3. The heating mechanism, as described in claim 1, wherein each pin hole has a cross section that is less than one eighth inch in any direction measured from the pin hole axis.

4. The heating mechanism, as described in claim 1, wherein there are at least four plates spaced along said conduit; and each plate having multiple pin holes extending therethrough, whereby each plate exerts a heating action on the flowing liquid.

5. The heating mechanism, as described in claim 1, wherein there are at least four plates spaced along said conduit; said conduit having a central axis; each plate having multiple pin holes extending therethrough, whereby each plate exerts a heating action on the flowing liquid; and the pin holes in successive plates being offset in different directions from the conduit central axis, whereby the liquid undergoes a mixing action as it moves between successive plates.

6. The heating mechanism, as described in claim 1, wherein each said plate has at least fifty pin holes extending therethrough.

7. The heating mechanism, as described in claim 1, wherein the heat exchange liquid is oil.

8. The heating mechanism, as described in claim 1, wherein said means for supplying pressurized liquid to said conduit comprises a motor-operated pump; and means for regulating the heating action of said pin holes; and said regulating means comprising a temperature sensor responsive to elevated temperates produced by the heated liquid, and a pump controller operated by said temperature sensor.

9. The heating mechanism, as described in claim 1, and further comprising a hot water heater that includes a helical water passage surrounding said flow conduit, whereby the heated liquid flowing through said conduit transfers heat to the water in said helical water passage.

10. The heating mechanism, as described in claim 1, and further comprising a hot water heater that includes a helical water passage surrounding said flow conduit, a first annular duct connected to said flow conduit within the space circumscribed by the helical water passage, and a second annular duct connected to said first duct in surrounding relation to said helical water passage, whereby said helical passage is heated at its inner surface and at its outer surface.

* * * * *